US006955398B1

(12) United States Patent
Reese

(10) Patent No.: US 6,955,398 B1
(45) Date of Patent: Oct. 18, 2005

(54) POSTURE-ADJUSTABLE ROCKING CHAIR

(76) Inventor: Benjamin P. Reese, 20777 Mountain Dr., San Jose, CA (US) 95120

( * ) Notice: Subject to any disclaimer, the term of this patent is extended or adjusted under 35 U.S.C. 154(b) by 0 days.

(21) Appl. No.: 11/033,892

(22) Filed: Jan. 13, 2005

(51) Int. Cl.[7] ..... A47C 3/02
(52) U.S. Cl. ..... 297/271.6; 297/375
(58) Field of Search ..... 297/271.6, 271.5, 297/258.1, 317, 316, 322, 342, 341, 374, 297/452.13, 452.16, 375

(56) References Cited

U.S. PATENT DOCUMENTS 121,945 A * 12/1871 Kirsch ..... 472/102
267,678 A * 11/1882 Crandall ..... 472/102
1,230,642 A * 6/1917 Albano ..... 482/142
5,318,348 A * 6/1994 Hess ..... 297/440.11
5,382,072 A * 1/1995 Diefenbach ..... 297/1
6,811,217 B2 * 11/2004 Kane et al. ..... 297/270.2

* cited by examiner

*Primary Examiner*—Milton Nelson, Jr.
(74) *Attorney, Agent, or Firm*—Bacon & Thomas

(57) ABSTRACT

A rocking chair includes a frame and pads mounted to the frame for supporting a sitter. The frame includes a chair body having a seat portion and a seatback pivotally coupled to the seat portion and a rocker base having two concave rocker bars located on opposite sides of the chair body and two convex top bars having ends mounted to the rocker bars respectively with a stretch bar extending between each top bar and each rocker bar in an inclined manner. Opposite side edges of the seatback are pivoted to the top bars of the rocker base and opposite side edges of the seat portion are coupled to stretch bars by slide joints that are movably mounted to and selectively secured along the stretch bar.

16 Claims, 7 Drawing Sheets

POSTURE-ADJUSTABLE ROCKING CHAIR

BACKGROUND OF THE INVENTION

1. Field of the Invention

The present invention relates to a rocking chair, and in particular to a rocking chair comprising seat and seatback that are relatively movable with respect to each other for adjustment of the posture of a sitter on the chair.

2. The Related Art

A rocking chair is comprised of a chair supported on a rocker base. The rocker base comprises two concave curved rocker bars on opposite sides of the chair. The curved configuration of the rocker bars allows the chair to rock forward and backward. Conventionally, the rocking chair comprises a seat on which a person may sit and a seatback fixedly attached to and extending upward from the seat to support the back of the person. The seatback is not allowed to move with respect to the seat and the general posture that the person may take up on the chair is subject to the fixed structure of the chair. Changing posture would require the own effort of the sitter. This is certainly troublesome to people who are physically weak, such as patients and the old. Changing posture on a rocking chair also upsets the balance of "center of gravity". This creates an dangerous and unstable chair.

Thus the present invention is aimed to provide a rocking chair that overcomes the drawbacks of the prior art by allowing adjustment of the spatial relationship between parts, which allows the center of gravity and balance to remain fixed even when the posture is changed.

SUMMARY OF THE INVENTION

A primary objective of the present invention is to provide a rocking chair comprising a seat and a seatback that is rotatable with respect to the seat to adjust the posture that a sitter may take up on the chair by changing the included angle between the seat and the seatback.

Another objective of the present invention is to provide a rocking chair comprising a posture adjusting mechanism featuring relative rotation of a seatback with respect to a seat that is realized in a stepless manner whereby ready adjustment of posture and comfort of sitting and a safe rocking motion can be achieved.

In accordance with the present invention, to realize the above objectives, a posture-adjustable rocking chair comprises a rocker base on which a chair body is supported. The chair body comprises a seat and a seatback pivoted to the seat. The rocker base is comprised of two concave curved rocker bars on opposite sides of the chair body. A convex, arch-like top bar has two ends mounted to each rocker bar and is pivotally coupled to each side edge of the seatback. A stretch bar extends between the top bar and the rocker bar in an inclined manner and slidably carries a slide joint that is selectively secured at any position along the stretch bar. Opposite edges of the seat are rotatably attached to the slide joints of the stretch bars on opposite sides of the chair body. The sliding movement of the slide joint along the stretch bar causes the seat the move, which in turn forces the seatback to rotate with respect to the seat due to the constraint imposed by the pivotal coupling between the seatback and the top bar. Thus, the relative position of the seatback with respect to the seat is changed and the posture that a sitter takes up on the chair is changed accordingly.

The present invention will become more obvious from the following description when taken in connection with the accompanying drawings, which show, for purposes of illustration only, a preferred embodiment in accordance with the present invention.

DETAILED DESCRIPTION OF THE PREFERRED EMBODIMENT

Figure 1:
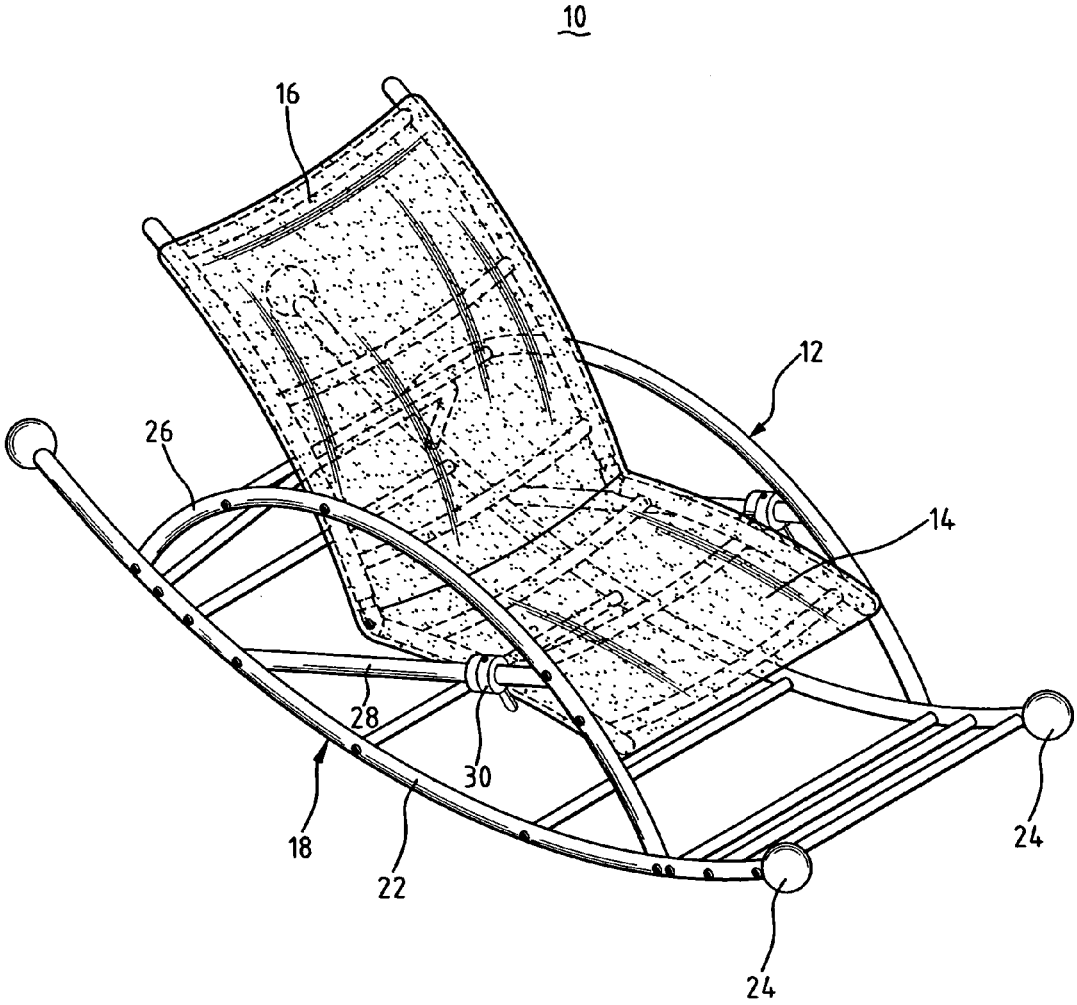
FIG. 1 is a perspective view of a rocking chair constructed in accordance with the present invention.
Figure 2:
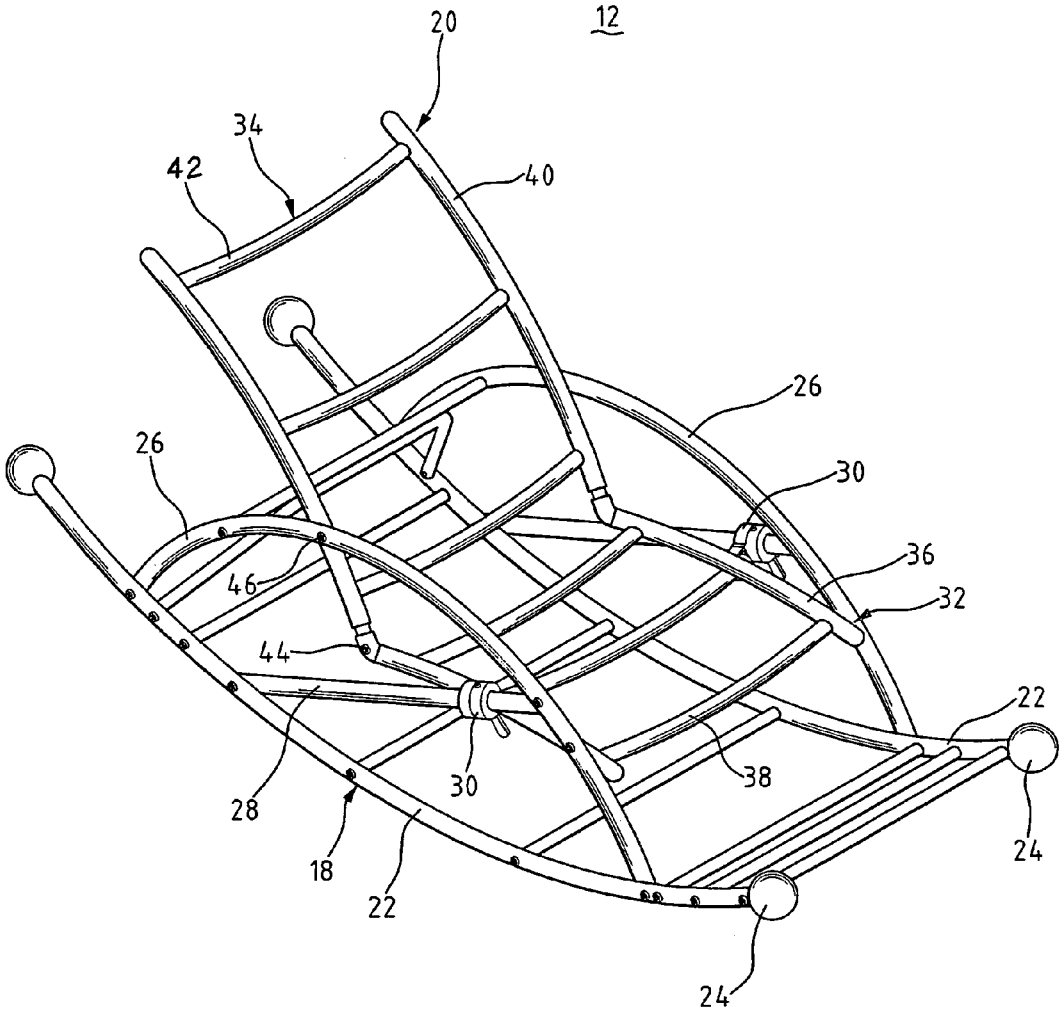
FIG. 2 is similar to FIG. 1 but with a cushion or flexible covering removed to clearly show a frame of the chair.

Referring to the drawings and in particular FIGS. 1 and 2, a rocking chair constructed in accordance with the present invention, generally designated with reference numeral 10, comprises a frame 12, particularly shown in FIG. 2, and a seat pad 14 and a back pad 16 mounted to the frame 12 to support a sitter (not shown) thereon. The seat pad 14 and the back pad 16 can be separate pieces or integrated together as a unitary pad. The seat pad 14 and the back pad 16 can be of different structures and made of different or same flexible materials that comfortably support the sitter thereon. Since pad or cushion of a chair or seat is generally known, no further detail will be given hereinafter.

Figure 7:
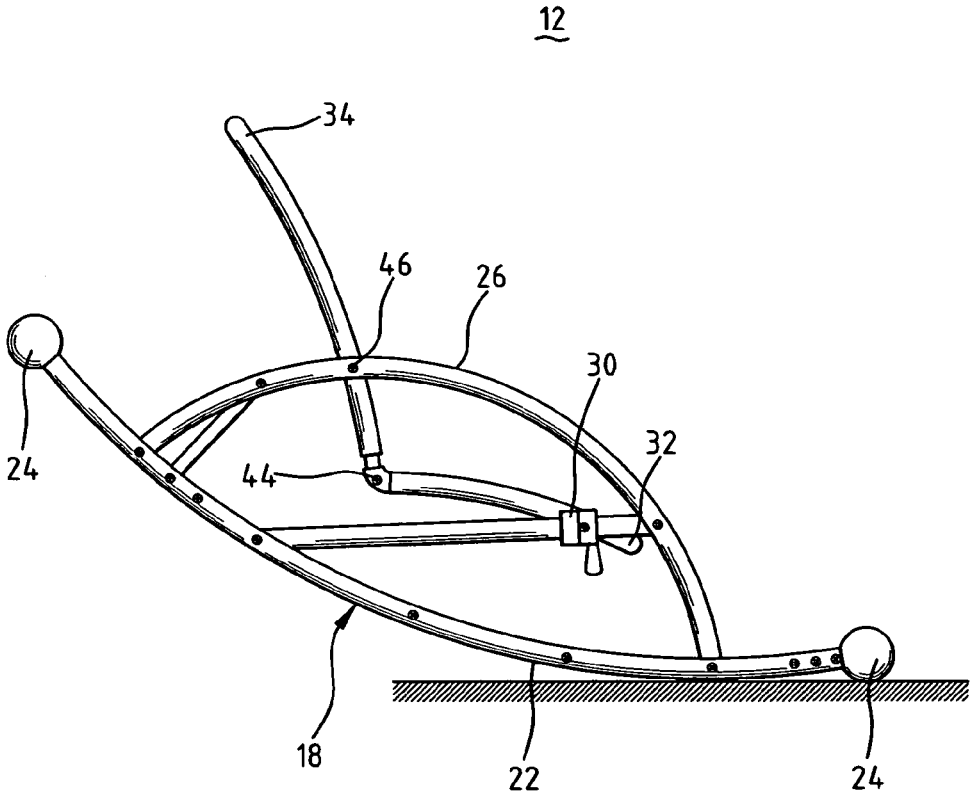
FIG. 7 is a side elevational view similar to FIG. 3, illustrating the to-and-fro rocking of the rocking chair.

The chair frame 12 comprises a rocker base 18 and a chair body 20 mounted on the rocker base 18. The rocker base 18 comprises two rocker bars 22 located on opposite sides of and below the chair body 20. As generally known, each rocker bar 22 assumes an upward concave shape, allowing to-and-fro rocking motion. Each rocker bar 22 has opposite ends on each of which a spherical member or an expanded portion 24 is formed to serve as a stop for the rocking motion, as illustrated in FIG. 7. A convex, arch-like top bar 26 has opposite ends mounted to the rocker bar 22 by any known means, such as bolts and rivets. A stretch bar 28 is fixed to and extends between the top bar 26 and the rocker bar 22 in an inclined manner.

A slide joint 30 is slidably mounted on the stretch bar 28 and is selectively secured along the stretch bar 28 for adjustment purposes. The slide joint 30 can be of any known structure. An example of the slide joint 30, which is illustrated in the present embodiment, is disclosed in a co-pending patent application (Ser. No. 10/999,927) filed by the present inventor. Those interested in the structure of the slide joint may refer to the co-pending application and thus no further detail will be given hereinafter unless it is necessary to the understanding of the present invention.

The chair body 20 comprises a seat portion 32 and seatback 34. The seat portion 32 is comprised of two spaced side bars 36 connected by cross bars 38 extending therebetween, forming a frame to support the seat pad 14 thereon. The seatback 34 is comprised of two spaced side bars 40 connected by cross bars 42 extending therebetween, forming a frame to support the back pad 16. The seatback 34 is pivoted to the seat portion 32 by having lower ends of the side bars 40 of the seatback 34 pivotally coupled, at 44, to rear ends of the side bars 36 of the seat portion 32. An inclined angle is thus formed between the seat portion 32 and the seatback 34, which angle is adjustable by rotating the seatback 34 about the pivotal coupling with respect to the seat portion 32.

The chair body 20 is sized to locate between the top bars 26 of the rocker base 18. The seatback 34 is coupled to the rocker base 18 by pivoting the side bars 40 of the seatback 34 to the top bars 26 of the rocker base 18 with pivots 46.

Figure 4:
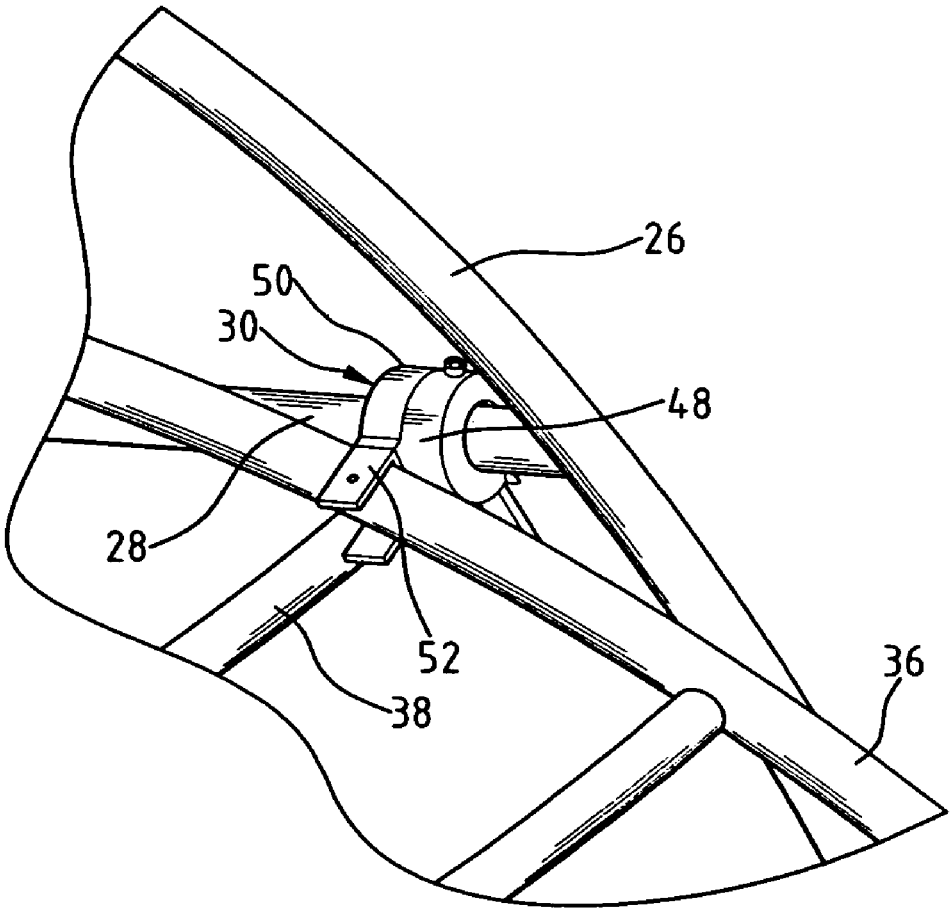
FIG. 4 is an enlarged view of a slide joint that couples a chair body of the rocking chair to a rocker base.

Also referring to FIG. 4, the seat portion 32 is coupled to the stretch bars 28 by means of the slide joints 30. The slide joint 30 comprises a cylinder 48 and a locking ring 50, both defining bores partially overlapping each other with central axes of the bores offsetting with respect to each other. The stretch bar 28 extends through the bores of both the cylinder 48 and the locking ring 50. By making a rotation of a predetermined angle of the locking ring 50 with respect to the cylinder 48, the slide joint 30 is releasably secured on the stretch bar 28. Thus, by locking/unlocking the locking ring 50 with respect to the cylinder 48, the slide joint 30 is allowed to move along the stretch bar 28. The slide joint 30 also comprises a coupling member 52 having a lying-down U-shape having spaced lugs (not labeled) receiving the side bar 36 of the seat portion 32 therein. The coupling member 52 is rotatable with respect to the slide joint 30.

Figure 5:
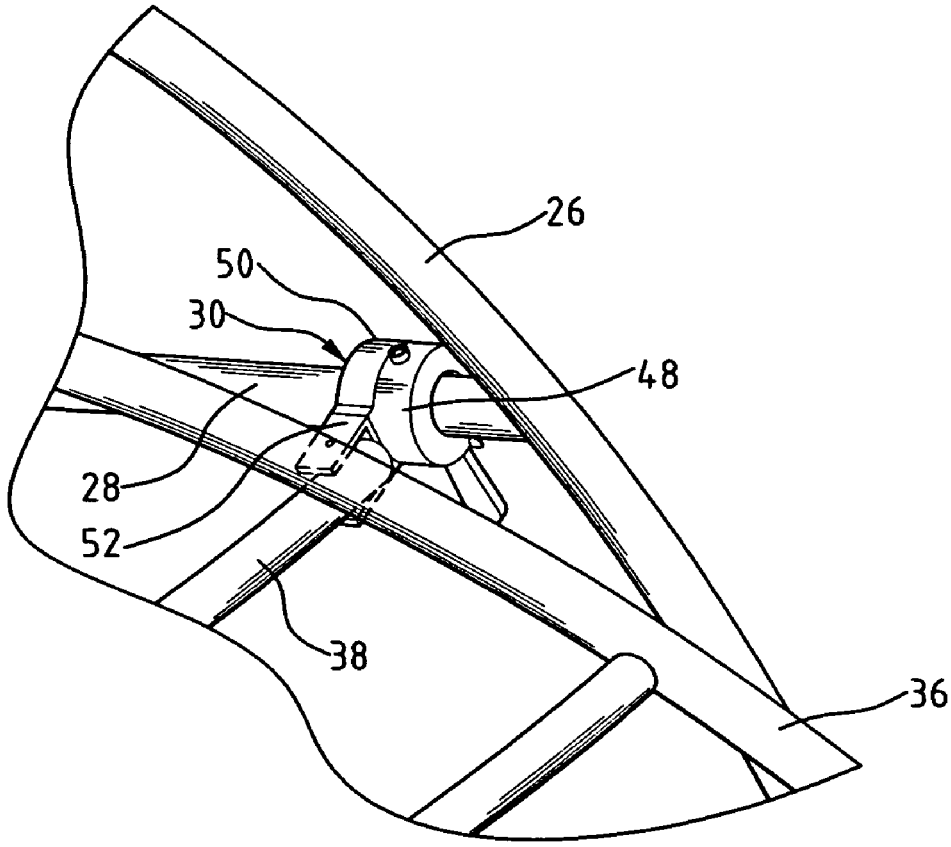
FIG. 5 is similar to FIG. 4 but showing a modification of the coupling between the chair body and the rocker base by the slide joint.

An alternative way for coupling the seat portion 32 to the stretch bars 28 by the slide joints 30 is illustrated in FIG. 5, wherein one of the cross bars 38 has ends extending beyond the side bars 36 and received between and fixed to the lugs of the U-shaped coupling members 52 of the slide joints 30.

Figure 3:
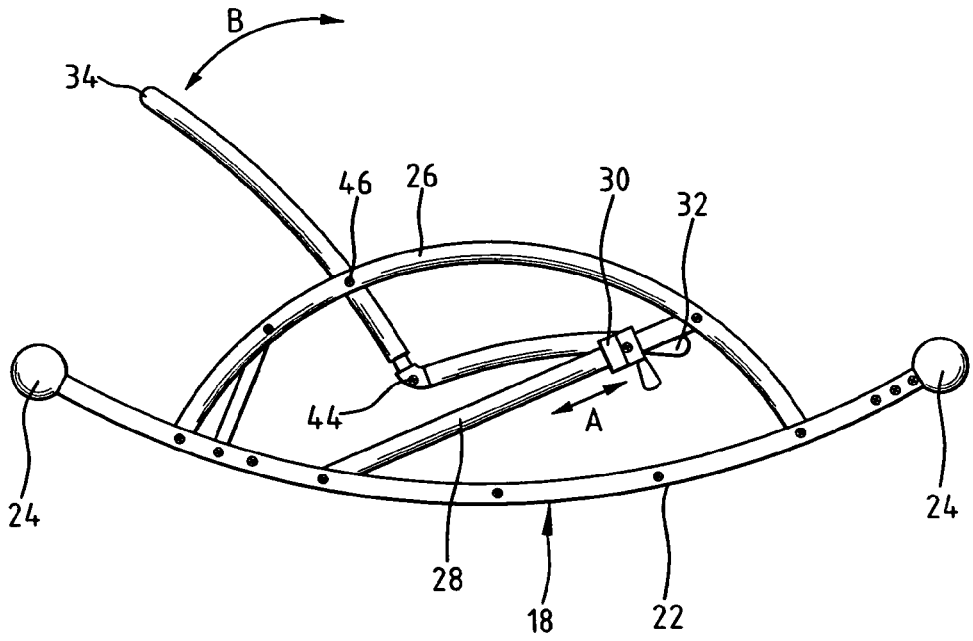
FIG. 3 is a side elevational view of the chair frame illustrated in FIG. 2.
Figure 6:
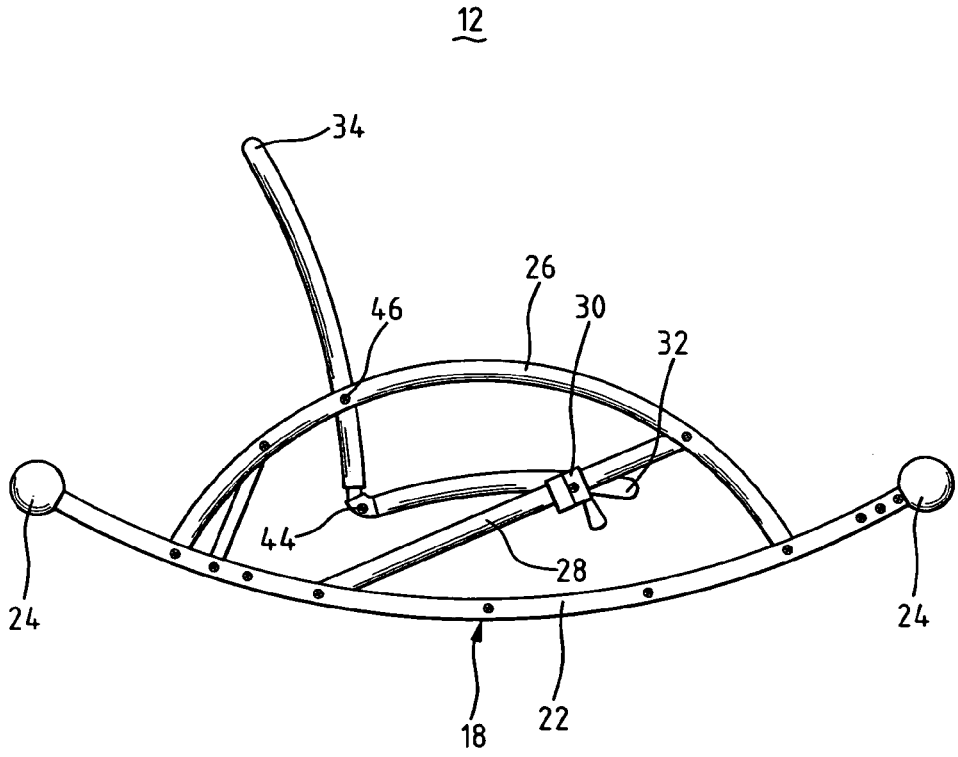
FIG. 6 is similar to FIG. 3 but showing a seatback of the chair body moved to a position different from that of FIG. 3 to illustrate the adjustment of the seatback with respect to a seat of the chair body.

Also referring to FIGS. 3 and 6, to operate, the slide joints 30 are released and moved along the stretch bars 28, as indicated by arrow A of FIG. 3, from an initial position as shown in FIG. 3 to a destination position as shown in FIG. 6. Due to the pivotal coupling 44 between the seatback 34 and the seat portion 32, and the pivoting connection between the seatback 34 and the top bars 26 of the rocker base 18, the movement of the slide joints 30 along the stretch bars 28 causes the seatback 34 to move with respect to the seat portion 32, which, as indicated by arrow B of FIG. 3, changes the inclined angle between the seatback 34 and the seat portion 32, which in turn changes the posture that the sitter may assume on the rocking chair 10.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A rocking chair comprising:

a frame comprising:

a chair body comprising a seat portion and a seatback pivotally coupled to the seat portion so as to rotate between first and second positions with respect to the seat portion;

a rocker base comprising two concave rocker bars located on opposite sides of the chair body and two convex top bars each having ends mounted to each rocker bar, a stretch bar extending between each top bar and each rocker bar in an inclined manner; and a slide joint movably mounted on each stretch bar and selectively secured along the stretch bar on at least an initial position and a destination position;

wherein opposite side edges of the seatback are pivoted to the top bars of the rocker base and opposite side edges of the seat portion are coupled to the slide joints, and wherein by selectively moving the slide joints from the initial position to the destination position, the seatback is caused to rotate with respect to the seat portion from the first position to the second position to change an inclined angle therebetween.

2. The rocking chair as claimed in claim 1, wherein the seatback comprises two spaced side bars defining the side edges of the seatback and cross bars extending between and fixed to the side bars.

3. The rocking chair as claimed in claim 1, wherein each rocker bar has opposite ends on each of which an expanded portion is formed.

4. The rocking chair as claimed in claim 3, wherein the expanded portion is spherical.

5. The rocking chair as claimed in claim 1, wherein the seat portion comprises two spaced side bars defining the side edges of the seat portion and cross bars extending between and fixed to the side bars.

6. The rocking chair as claimed in claim 5, wherein the seatback comprises two spaced side bars defining the side edges of the seatback and cross bars extending between and fixed to the side bars, lower ends of the side bars of the seatback being respectively pivoted to rear ends of the side bars of the seat portion to define the inclined angle between the seatback and the seat portion.

7. The rocking chair as claimed in claim 1 further comprising a seat pad mounted to and supported by the seat portion and a back pad mounted to and supported by the seatback.

8. The rocking chair as claimed in claim 7, wherein the seat portion comprises two spaced side bars and cross bars extending between and fixed to the side bars, one of the cross bars having an opposite end projecting beyond the side bars to define the side edges of the seat portion, and wherein the seatback comprises two spaced side bars defining the side edges of the seatback and cross bars extending between and fixed to the side bars, lower ends of the side bars of the seatback being respectively pivoted to rear ends of the side bars of the seat portion to define the inclined angle between the seatback and the seat portion.

9. The rocking chair as claimed in claim 7, wherein the seat pad is integrated with the back pad as a unitary member.

10. The rocking chair as claimed in claim 7, wherein each rocker bar has opposite ends on each of which an expanded portion is formed.

11. The rocking chair as claimed in claim 10, wherein the expanded portion is spherical.

12. The rocking chair as claimed in claim 7, wherein the seat portion comprises two spaced side bars defining the side edges of the seat portion and cross bars extending between and fixed to the side bars and wherein the seatback comprises two spaced side bars defining the side edges of the seatback and cross bars extending between and fixed to the side bars, lower ends of the side bars of the seatback being respectively pivoted to rear ends of the side bars of the seat portion to define the inclined angle between the seatback and the seat portion.

13. A rocking chair comprising:

a frame comprising:

a chair body comprising a seat portion and a seatback pivotally coupled to the seat portion so as to rotate between first and second positions with respect to the seat portion, the seat portion comprising two first side bars that are spaced from and opposite to each other and first cross bars extending between and fixed to the first side bars, the seatback comprising two second side bars that are spaced from and opposite to each other and second cross bars extending between and fixed to the second side bars, ends of the second side bars of the seatback being respectively pivoted to corresponding ends of the first side bars of the seat portion to define an included angle between the seatback and the seat portion, a rocker base comprising two concave rocker bars located on opposite sides of the chair body and two convex top bars each having ends mounted to each rocker bar, a stretch bar extending between each top bar and each rocker bar in an inclined manner, said second side bars of the seatback being pivoted to the top bars of the rocker base, said first side bars of the seat portion are coupled to slide joints, and a said slide joint movably mounted on each stretch bar and selectively secured along the stretch bar on at least an initial position and a destination position, so that by selectively moving the slide joint from the initial position to the destination position, the seatback is caused to rotate with respect to the seat portion from the first position to the second position to change the inclined angle therebetween; and a seat pad mounted to and supported by the seat portion and a back pad mounted to and supported by the seatback.

14. The rocking chair as claimed in claim 13, wherein the seat pad is integrated with the back pad as a unitary member.

15. The rocking chair as claimed in claim 13, wherein each rocker bar has opposite ends on each of which an expanded portion is formed.

16. The rocking chair as claimed in claim 15, wherein the expanded portion is spherical.

* * * * *